United States Patent [19]

Gray, III

[11] Patent Number: 4,548,548

[45] Date of Patent: Oct. 22, 1985

[54] FAN AND HOUSING

[75] Inventor: Leslie M. Gray, III, Belmont, Mass.

[73] Assignee: Airflow Research and Manufacturing Corp., Watertown, Mass.

[21] Appl. No.: 613,958

[22] Filed: May 23, 1984

[51] Int. Cl.[4] ..... F28F 13/06

[52] U.S. Cl. ..... 416/189; 123/41.49; 165/51; 165/121; 165/900; 415/210; 416/192

[58] Field of Search ..... 165/121, 122; 123/41.49, 41.65, 41.66; 415/210, 213; 416/189 R, 192

[56] References Cited

U.S. PATENT DOCUMENTS

| | | | |
|---|---|---|---|
| 16,547 | 2/1857 | Marshall . | |
| 562,020 | 6/1896 | Peabody . | |
| 1,062,258 | 5/1913 | Schlotter . | |
| 1,408,715 | 3/1922 | Seelig . | |
| 1,795,588 | 3/1931 | Wilson . | |
| 1,993,158 | 3/1935 | Funk . | |
| 2,154,313 | 4/1939 | McMahan . | |
| 2,628,019 | 2/1953 | Koch . | |
| 2,687,844 | 8/1954 | Woodward . | |
| 3,168,235 | 2/1965 | Valdi | 415/213 C |
| 3,481,534 | 12/1969 | Price . | |
| 3,680,977 | 8/1972 | Rabouyt et al. | 416/192 |
| 3,995,970 | 12/1976 | Nobuyuki | 415/210 |
| 4,181,172 | 1/1980 | Longhouse | 165/121 |
| 4,329,946 | 5/1982 | Longhouse | 415/123 C |
| 4,358,245 | 11/1982 | Gray . | |
| 4,396,351 | 8/1983 | Hayashi et al. | 123/41.49 |
| 4,459,087 | 7/1984 | Barge | 123/41.49 |

FOREIGN PATENT DOCUMENTS

| | | | |
|---|---|---|---|
| 2913922 | 10/1980 | Fed. Rep. of Germany | 415/213 C |

*Primary Examiner*—William R. Cline
*Assistant Examiner*—John J. McGlew, Jr.

[57] ABSTRACT

A circumferentially banded fan that forces air through an adjacent heat exchanger and that has an air-guide housing positioned radially outside the band and extending downstream therefrom is disclosed. A plurality of elongated stationary members extend radially inwardly from the housing downstream from the fan blades, and the stationary members have a flow-control surface which removes the rotational component imparted to the airflow by the rotating fan blades. A tangent to the flow control surfaces at their radial center line forms an angle with the airflow exiting the blades which is substantially equal to the tangent-to-axis angle.

13 Claims, 6 Drawing Figures

FAN AND HOUSING

BACKGROUND OF THE INVENTION

This invention relates to fans which are used to move air through a heat exchanger.

Such fans customarily have a hub which is rotated about its axis, for example by an electric motor or by an engine, and a plurality of blades extending radially from the hub. The blades are pitched at an angle to pump air when rotated, and that air is either blown through a heat exchanger, if the heat exchanger is on the high-pressure (downstream) side of the fan, or drawn through the heat exchanger, if the exchanger is on the low-pressure (upstream) side of the fan.

The air flow generated by the fan is relatively complex. As the blades rotate, air is driven in a direction oblique to the axis (i.e., at an angle between the radial plane of the fan and the fan axis). Thus, the fan exhaust has both an axial component and a rotational component imposed by the blades. Struts which support the motor also deflect the airflow. Finally, vortices which form at the fan blade tips further complicate the air flow.

In many applications, one or more of these efficiency-reducing factors results in relatively higher design costs because of the need for greater fan-rotating power and/or additional design and manufacturing features.

McMahan U.S. Pat. No. 2,154,313 discloses a fan for blowing air through a heat exchanger. A set of vanes is positioned on the downstream side of the fan blades to correct the variation in velocity at different radial positions by radially deflecting the airflow exiting the fan blades. The resulting more radially uniform air flow velocity is intended to improve efficiency of the heat exchanger.

Koch U.S. Pat. No. 2,628,019 discloses a free-standing fan having vanes to concentrate the air flow to maintain velocity and reduce diffusion.

Gray U.S. Pat. No. 4,358,245 discloses a fan for drawing air through a radiator; the fan includes a circumferential band around the blade tips, and a shroud which reduces recirculation of air around the outer edge of the fan.

SUMMARY OF THE INVENTION

The invention features a circumferentially banded fan with an air-guide housing positioned radially outside the band and extending downstream therefrom. A plurality of elongated stationary members extend radially inwardly from the housing downstream from the fan blades, and the stationary members have flow-control surfaces which remove the rotational component imparted to the airflow by the rotating fan blades. The nose-tail line of a stationary member forms an angle with the airflow exiting the blades which is substantially equal to the angle between the nose-tail line and the fan axis. As used herein the nose-tail line is the line connecting the center of the leading (upstream) edge of the stationary member to the center of the trailing (downstream) edge of the stationary member.

In preferred embodiments a fan motor rotates the fan, and at least some of the stationary members are used to support the fan motor. The fan draws air through an upstream heat exchanger and the housing extends upstream to the circumference of the heat exchanger. The airflow control surfaces are concave; that is, the surface is curved so that lines normal to it converge on the side of the stationary member which the rotating blade first encounters. To account for variation in the airflow direction at different radial and/or circumferential positons, the nose-to-tail line/fan axis angles of the stationary member surfaces can be designed with corresponding radial and circumferential variation; alternatively, the nose-to-tail line/fan axis angles are kept uniform and matched to the nose-to-tail line/airflow direction angle in the region where the airflow velocity is greatest. The total area of the stationary member surfaces is at least 30% of the fan blade surface area. The stationary members are cambered at a chamber/chord ratio of between 0.06 and 0.18. The number of stationary members is controlled so as not to be an even multiple of the number of fan blades.

The banding of the fan effectively eliminates the tip vortex, even for fans with relatively lenient tolerances on the tip-to-housing gap. This reduction in top vortices is critical to making it possible to control airflow with the curved stationary members matched to the fan-blade output as described above, with a net gain in efficiency.

Fan efficiency is improved because:

(1) removing the rotational component of the airflow reduces energy lost as wasted rotational energy; the stationary members thus give a net thrust (negative drag) providing in effect a second fan;

(2) the total pressure differential across the fan/stator assembly is the sum of the pressure differential across the blades and the differential across the stationary members; the differential across the blades is therefore less than would be true for a fan without the stationary members and thus the efficiency lost from recirculation around the band of the fan is reduced;

(3) the removal of drag from radially extending conventional motor support arms further increases fan efficiency; and (4) where the fan is designed to blow air through the heat-exchanger, its axially directed exhaust, minus rotational components, provides improved heat transfer and efficiency due to smoother flow through the heat exchanger.

Other features and advantages of the invention will be apparent from the following description of the figures and the preferred embodiment, and from the claims.

DESCRIPTION OF THE PREFERRED EMBODIMENTS

STRUCTURE

Figure 1:
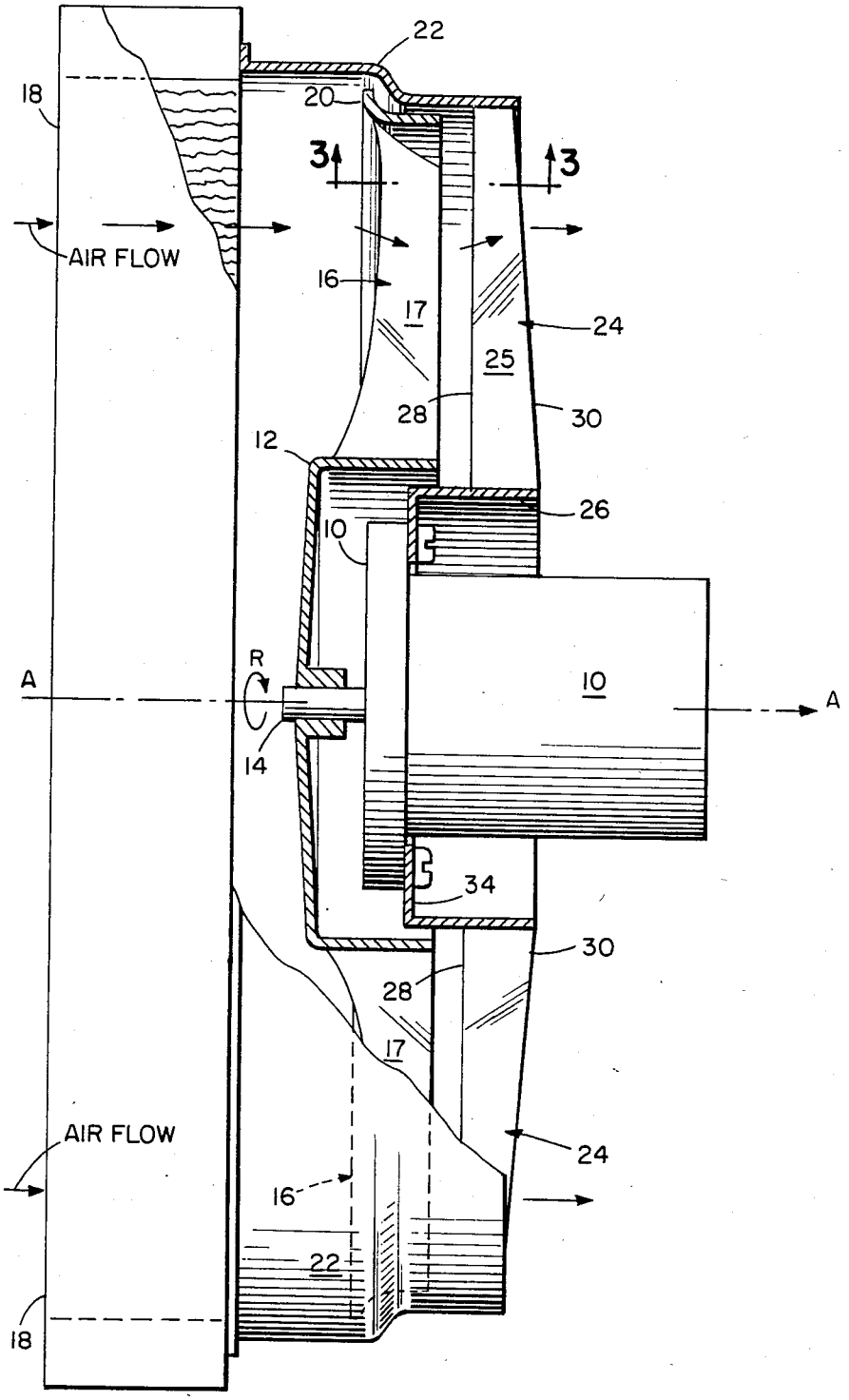
FIG. 1 is a side view, partially broken away and in section, taken along 1—1 of FIG. 2.

FIG. 1 shows an auto fan system for drawing air (left to right) through a heat exchanger 18 e.g. of an automobile. The fan includes an electric motor 10 connected to the center of cylindrical fan hub 12 through shaft 14. The axis of the fan is indicated by arrow A. The fan is designed to rotate in the direction indicated by arrow R. The fan includes a plurality (e.g. seven) of blades 16 (see FIG. 2), which may be of any suitable design, but preferably are rearwardly skewed as described in my copending U.S. patent application Ser. No. 544,988, filed Nov. 8, 1983. Alternatively, the blades may be forwardly skewed as described in Gray U.S. Pat. No. 4,358,245. Both the patent application and patent are hereby incorporated by reference.

Figure 2:
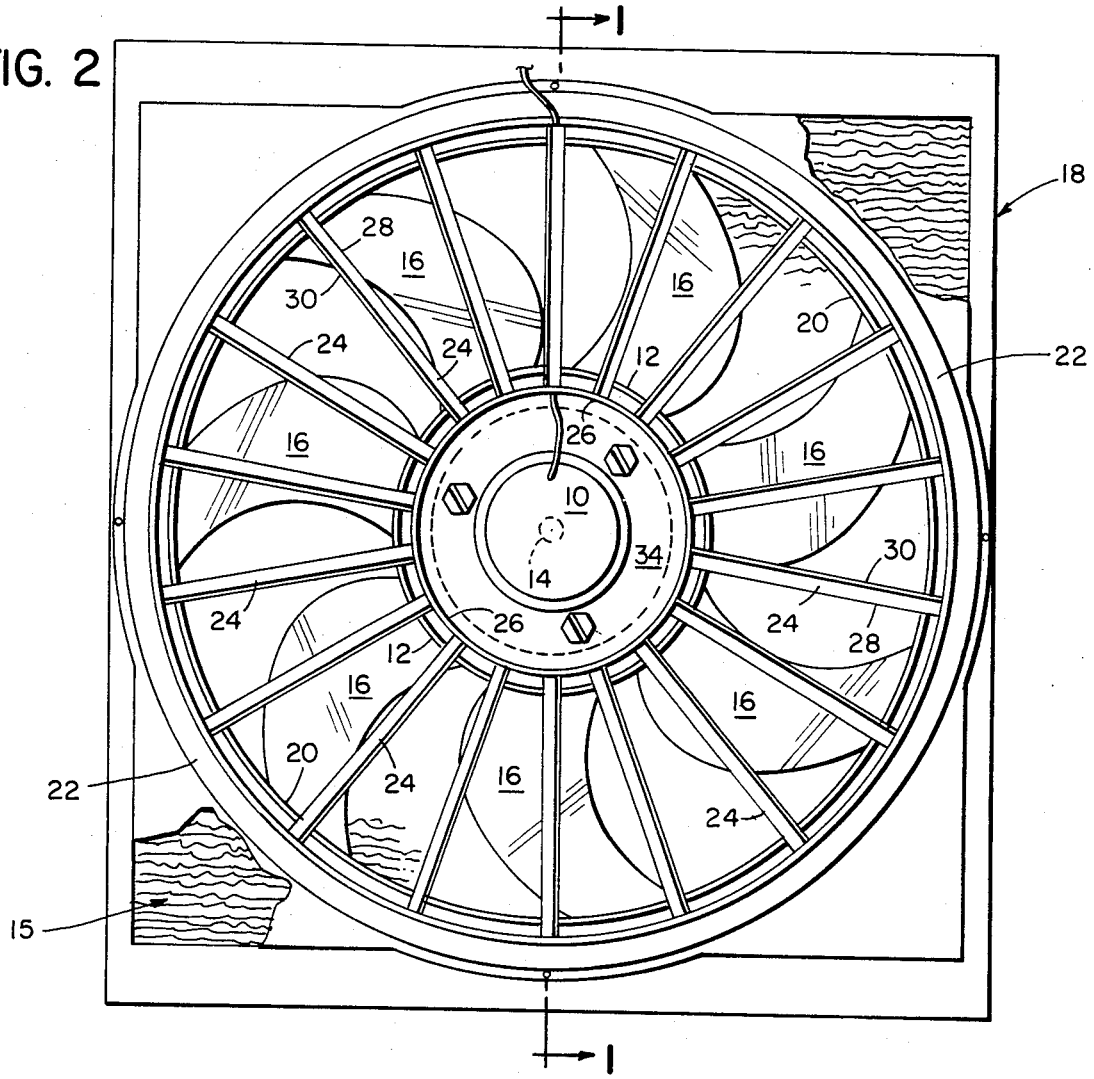
FIG 2 is a view looking upstream, with parts broken away, of a fan drawing air through an upstream heat exchanger.

In FIG. 2, the tips of blades 16 are attached to a circumferential band 20 which is concentric about axis A. The structure and aerodynamics of band 20 are shown in detail in U.S. Pat. No. 4,358,245 which is hereby incorporated by reference. Blades 16 have airflow deflecting surfaces 17.

A housing 22 extends axially from the circumference of radiator 18 to a position rearward of the plane of blades 16. A plurality, e.g., eighteen, elongated stationary members 24 extend radially inward from the rear of housing 22 to a cylindrical motor mount 26 positioned co-axially with the fan. Members 24 have airflow deflecting surfaces 25.

Figure 3:
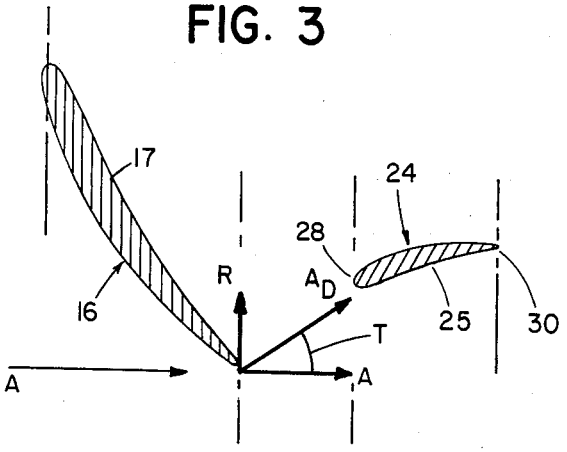
FIG. 3 is a diagrammatic sectional view of the blade and stationary members of the fan of FIG. 1.

FIG. 3 shows diagrammatically the orientation of a fan blade 16 and a stationary member 24 with respect to axis A. As blade 16 rotates in direction R, air is discharged in direction $A_D$ at an angle T to axis A. The size of angle T depends on the rate of fan rotation, the orientation of blade 16, and the radial distance from hub 12.

Figure 3A:
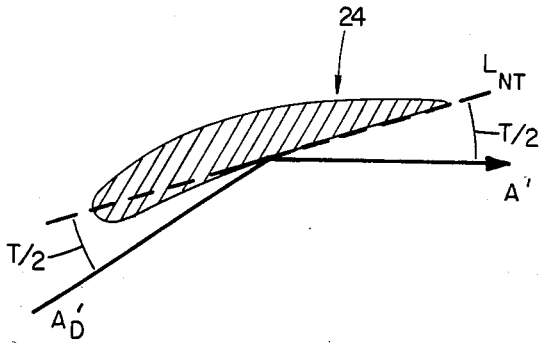
FIG. 3A is an enlargement of the stationary member cross-section shown in FIG. 3.

FIG. 3A shows that the nose-tail line ($L_{NT}$) of the flow-control surface intersects a line ($A_D'$) parallel to the airflow discharge direction at angle T/2; similarly, $L_{NT}$ intersects a line ($A^1$) parallel to the axis at angle T/2. The airflow incident to surface 25 at angle T/2 is thus reflected axially at angle T/2. While it may not be possible to maintain such a relationship with precision due to various factors including the variability of the air discharge direction, it is preferable to avoid more than 10° divergence from the above-prescribed angular relationship; however, the advantages of the invention are achieved even when the divergence is slightly greater, for example 15°.

The stationary members should be oriented as described above with regard to the direction of blade discharge airflow. That direction in turn depends upon fan loading and fan blade angle. Thus for lightly loaded fans, the blade exhaust direction is approximately 15° from axial, while for heavily loaded fans it can be 45° or more from axial.

The process of positioning and designing the stationary members involves surveying the airflow discharge velocity and direction, both at different points along a given fan radius and at different circumferential points having a given radius. Suitable equipment such as a two-dimensional Pitot tube or crossed hot wires can be used for this purpose. The discharge angle may vary radially and/or circumferentially, with the greatest airflow velocity taking place in a particular radial and/or circumferential region of the fan. If each of the stationary members is to have the same curvature and such curvature is to be uniform at all points along the lengths of those members, that curvature should be arranged so that above-prescribed nose-tail line angular relationships obtain at the region of highest velocity, in order to obtain the advantages of the invention at the point where the work done is greatest. Alternatively, the stationary member surface curvature may be varied radially and/or circumferentially so that the above prescribed angular relationships obtain for all or most of the fan discharge.

Between its leading and trailing edges, the stationary member 24 is cambered, both for strength and performance. Preferably the camber/chord ratio [i.e., the ratio between the length of a chord and the length of a perpendicular to the chord, extending to the working surface 25 of the stationary member] is between 6% and 18%. The shape of the member may be either a curved plate shape or an airfoil housing having a reduced thickness at its forward and/or rearward edge(s).

To control noise, the number of stationary members should be controlled so that it is not an even multiple of the number of fan blades. In addition, the stationary members should have a radial profile line (i.e., a line connecting the mid-point of chords of a stationary member) which cannot be positioned to overlap the radial profile line of the passing fan blade. Thus, if the blades are skewed (see U.S. Pat. No. 4,358,245 or U.S patent application Ser. No. 549,998, both of which are hereby incorporated by reference) the stationary members may be radially straight. When the blades are unskewed (radially straight) it is desirable to skew the stationary members. There should at least be enough stationary members to support the fan motor. In considering the number and width of the members their total area should be at least 30% of the fan blade area to achieve the desired improvements. The total area of the stationary members can, if desired, exceed the fan blade area.

The stationary members are positioned downstream of the fan blades a distance at least $\frac{1}{4}$ of the length of the chord of the stationary members to minimize noise due to interaction between the fan and stationary members.

The housing extends upstream from the radially outward ends of the stationary members. Specifically, the housing is designed so that the stationary members terminate in a cylindrical section which is co-axial with the band of the fan blades. The axial clearance between the housing and the band should be minimized consistent with design costs and tolerances. Typically the clearance can be about 2% of the fan radius. An advantage of this invention is that the stability of airflow created by the various fan features enables larger housing-to-fan clearances without undue degradation of performance. As the housing extends rearward, it tapers inward from the circumference of the heat exchanger to the circumference of the blade band and stationary members.

Structurally, the housing and stationary members support the entire fan assembly. That is, the housing is externally supported (e.g., by the heat exchanger), and the stationary members support the fan motor which, in turn, supports the fan hub, blades and band. Specifically, the stationary members terminate at their radially inward ends at a fan motor mount 34 to which the fan motor is attached.

Manufacture

The housing and stationary members are made of injection molded plastic e.g. glass or mineral filled nylon or polypropylene. The fan hub blades and band are made in a similar way. The housing and stator members may be a single part, or two parts.

Operation

The rotation of the fan blades discharges air in a direction having both an axial and a rotational component, which average to direction $A_D$, the air discharge direction. The cambered stationary members straighten the airflow by converting the rotational component to an axial component with as little drag as possible, e.g., there is no attempt to even radial airflow velocity variations, because such evening would result in additional drag and loss of fan efficiency.

The resulting fan exhaust is generally axial, providing increased efficiency in terms of axial flow per motor energy consumed.

The system is useful, for example, in automobile radiator and air conditioner condenser cooling systems, particularly where an electrically driven motor moves air through a heat exchanger(s). In such systems, there are serious space constraints as well as a need for significant cost and energy efficiency.

Other Embodiments

Rather than draw air through an upstream heat exchanger, the fan may be used to blow air through a downstream heat exchanger. Reducing the rotational component reduces resistance to flow through the heat exchanger, thus improving heat exchanger efficiency. Other advantages of the invention are discussed above.

Figure 4:
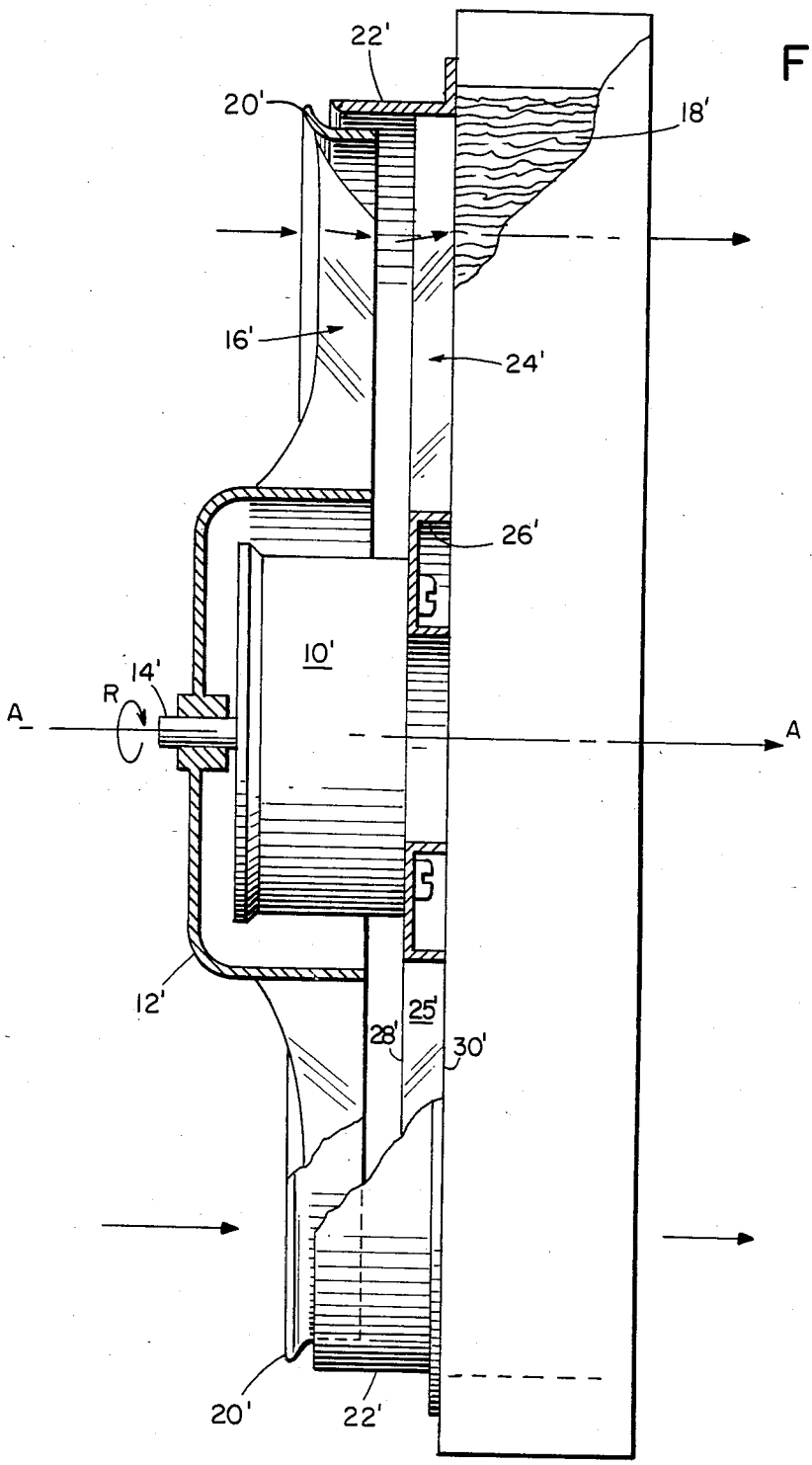
FIG. 4 is a side view, partially broken away and in section taken along 4—4 of FIG. 5.
Figure 5:
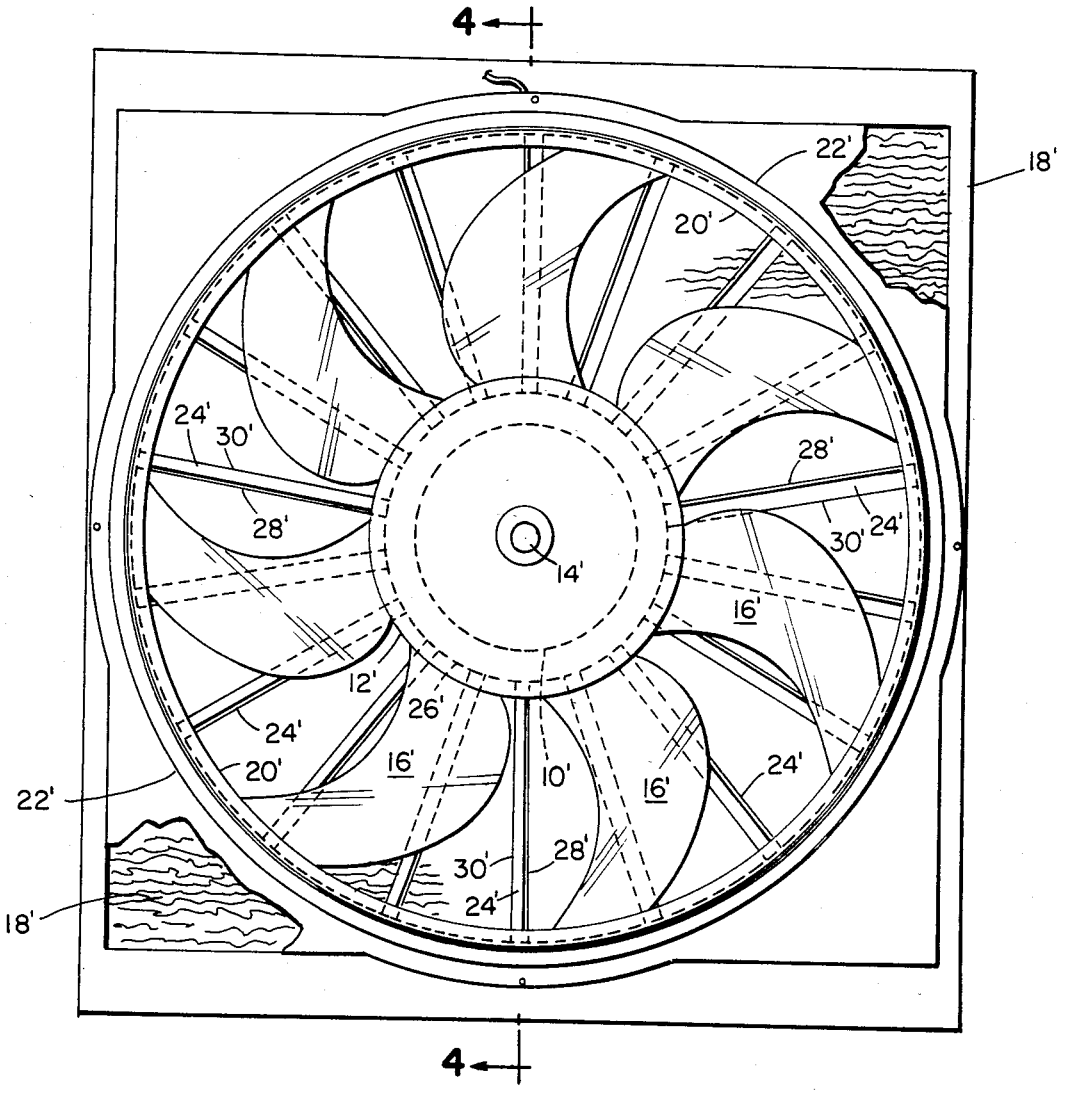
FIG. 5 is a view looking downstream, with parts broken away, of a fan blowing air through a downstream heat exchanger.

FIGS. 4 and 5 show such a fan which includes a fan motor 10', housing 22', stationary members 24' and heat exchanger 18'. The downstream edges of stationary members 24' define a plane which is perpendicular to the fan axis, so as to minimize space between the members and the upstream face of the heat exchanger. Other parts and elements are designated by primed numbers which correspond to the numbers used for the embodiment of FIGS. 1–3.

Other embodiments are within the scope of the following claims.

I claim:

1. In combination, a fan and air-guide housing adapted to support a motor and move air through a heat exchanger, said combination comprising:

a fan hub connectable to said motor for rotation on a central axis;

a plurality of elongated blades extending radially outwardly from said hub, each of said blades comprising a surface that is pitched with respect to said axis, so that rotation of said hub causes airflow in a direction generally oblique to said axis;

a circumferential band which connects the tips of said blades and extends about said axis concentrically with said hub;

a housing extending downstream from a region radially outward of said band, and a plurality of plastic elongated stationary members positioned downstream of said fan blades and extending from said housing radially inwardly to a means for supporting said fan motor, each of said members comprising a flow-control surface oblique to said airflow direction, and said member surfaces being positioned and configured so that, at least at the region of greatest air-flow velocity, the nose-tail line of said surfaces intersects said airflow direction at an angle substantially equal to the angle between said nose-tail line and a line parallel to the fan axis, said member surfaces having a total area of at least 30% of the area of said fan blade surface area, whereby said flow control surfaces deflect said airflow axially.

2. The combination of claim 1 wherein said flow-control surfaces are concave.

3. The combination of claim 1 wherein said combination is adapted for attachment to an upstream heat exchanger, and said housing extends upstream from said band.

4. The combination of claim 1 wherein said combination is adapted for attachment to a downstream heat exchanger, and said housing extends downstream from said fan.

5. The combination of claim 1 wherein said stationary members are cambered, having a chamber/chord ratio of between 0.06 and 0.18.

6. The combination of claim 1 wherein the number of said stationary members is not an even (integer) multiple of the number of said blades.

7. The combination of claim 1 wherein said blades are skewed and said stationary members are unskewed.

8. The combination of claim 1 wherein said airflow direction at a first region along a given fan radius is different from the airflow direction at a second region along said given fan radius, and said nose-tail line/axis angle of the stationary member surface along said given radius varies, so that in both said first region and in said second region said nose-tail line/axis angle is substantially equal to said airflow-direction angle.

9. The combination of claim 1 wherein said airflow direction at a first region along a given fan radius is different from the airflow direction at a second region along said given fan radius, the airflow velocity is greater at said first region than the airflow velocity at said second region, and the nose-tail line/axis angle of the stationary member surface along said given radius is constant and is substantially equal to the nose-tail line-/airflow-direction angle at the first said radial region.

10. The combination of claim 1 wherein said airflow direction at a first region having a given fan radius is different from the airflow direction at a second region having said given fan radius, and both at said first region and at said second region, the nose-tail line/axis angles of said stationary member surfaces at said given radius are substantially equal to the respective nose-tail line-/airflow-direction angles experienced in the respective regions.

11. The combination of claim 10 wherein said airflow direction in said first region at said given fan radius is different from the airflow direction at a third region located along said given fan radius, and said nose-tail line/axis angle of the stationary member surface along said given radius varies so that in each of said first region said second region and said third region, said nose-tail line/axis angle is substantially equal to the nose-tail line/airflow-direction angle in said respective region.

12. The combination of claim 1 wherein said airflow direction at a first region having a given fan radius is different from the airflow direction at a second region having said given fan radius, the airflow velocity is greater in said first region than in said second region, and for at least two said stationary member surfaces, said nose-tail line/axis angle is kept constant and equal to the nose-tail line/airflow-direction angle at said first region.

13. The combination of claim 1 wherein said housing extends axially to means for attachment to said heat exchanger.

* * * * *

UNITED STATES PATENT AND TRADEMARK OFFICE

CERTIFICATE OF CORRECTION

PATENT NO. : 4,548,548

DATED : October 22, 1985

INVENTOR(S) : Leslie M. Gray III

It is certified that error appears in the above-identified patent and that said Letters Patent are hereby corrected as shown below:

Col. 2, line 18, "top vortices" should be --tip vortices--.

Signed and Sealed this

*Twenty-eighth* Day of *January 1986*

[SEAL]

*Attest:*

DONALD J. QUIGG

*Attesting Officer*

*Commissioner of Patents and Trademarks*